US009313858B2

(12) United States Patent
Van Bommel et al.

(10) Patent No.: US 9,313,858 B2
(45) Date of Patent: Apr. 12, 2016

(54) PHOSPHOR ENHANCED LIGHT SOURCE FOR PRESENTING A VISIBLE PATTERN AND A LUMINAIRE

(75) Inventors: Ties Van Bommel, Horst (NL); Rifat Ata Mustafa Hikmet, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 30 days.

(21) Appl. No.: 14/124,814

(22) PCT Filed: May 25, 2012

(86) PCT No.: PCT/IB2012/052646

§ 371 (c)(1),
(2), (4) Date: Dec. 9, 2013

(87) PCT Pub. No.: WO2012/168821

PCT Pub. Date: Dec. 13, 2012

(65) Prior Publication Data

US 2014/0097742 A1 Apr. 10, 2014

(30) Foreign Application Priority Data

Jun. 10, 2011 (EP) ..... 11169428

(51) Int. Cl.

| | |
|---|---|
| ***H05B 33/14*** | (2006.01) |
| ***F21K 99/00*** | (2010.01) |
| *F21Y 101/02* | (2006.01) |

(52) U.S. Cl.

CPC ..... *H05B 33/145* (2013.01); *F21K 9/56* (2013.01); *F21K 9/135* (2013.01); *F21Y 2101/02* (2013.01)

(58) Field of Classification Search

CPC ..... F21K 99/00; F21K 9/56; F21Y 2101/02; H05B 33/145

See application file for complete search history.

(56) References Cited

U.S. PATENT DOCUMENTS

| | | | | |
|---|---|---|---|---|
| 7,250,715 | B2 * | 7/2007 | Mueller et al. | 313/485 |
| 2007/0228931 | A1 * | 10/2007 | Kim et al. | 313/501 |
| 2009/0101930 | A1 | 4/2009 | Li | |
| 2010/0107459 | A1 * | 5/2010 | Hill | 40/443 |
| 2010/0129598 | A1 | 5/2010 | Su et al. | |
| 2010/0301360 | A1 * | 12/2010 | van de Ven et al. | 257/98 |
| 2011/0194272 | A1 * | 8/2011 | Li et al. | 362/84 |
| 2011/0228551 | A1 * | 9/2011 | Verschuren et al. | 362/555 |
| 2012/0081033 | A1 * | 4/2012 | Sun et al. | 315/294 |

(Continued)

FOREIGN PATENT DOCUMENTS

| | | | |
|---|---|---|---|
| EP | 1188352 | B1 | 4/2006 |
| EP | 2175436 | A1 | 4/2010 |

(Continued)

*Primary Examiner* — Thomas A Hollweg

(57) ABSTRACT

A phosphor-enhanced light source and a luminaire is provided comprising a light exit window, a light emitter, a luminescent layer. The light emitter emits light of a first color distribution towards the light exit window. The luminescent layer comprises first second areas, forming a pattern. A first characteristic of the first area is similar to a second characteristic of the second area to obtain a first light emission by the first area into the ambient and a second light emission by the second area into the ambient. The respective light emissions are experienced as similar by the viewer if the light emitter is in operation. A first reflection characteristic of the first area is different from a second reflection characteristic of the second area to obtain a first ambient light reflection by the first area that is different from a second ambient light reflection by the second area.

13 Claims, 6 Drawing Sheets

(56) References Cited

U.S. PATENT DOCUMENTS

| | | | | |
|---|---|---|---|---|
| 2013/0033164 | A1* | 2/2013 | Shani | 313/46 |
| 2013/0044457 | A1* | 2/2013 | Hikmet et al. | 362/84 |
| 2013/0135328 | A1* | 5/2013 | Rappoport et al. | 345/522 |

FOREIGN PATENT DOCUMENTS

| | | | |
|---|---|---|---|
| JP | 2004311039 | A | 11/2003 |
| WO | 0169692 | A1 | 9/2001 |
| WO | 2010086766 | A1 | 8/2010 |

* cited by examiner

PHOSPHOR ENHANCED LIGHT SOURCE FOR PRESENTING A VISIBLE PATTERN AND A LUMINAIRE

FIELD OF THE INVENTION

The invention relates to phosphor enhanced-light source which present a visible pattern to a viewer who looks towards the phosphor enhanced light source.

BACKGROUND OF THE INVENTION

Published patent application US2009/0101930 discloses a light emitting device which comprises a plurality of light emitters which emit light in a first wavelength range towards a light emitting surface which comprises a phosphor material. The phosphor material absorbs a part of the light in the first wavelength range and emits light in a second wavelength range. The light emitting surface has further so-termed window areas which does not comprise the phosphor material. Thus, if the light emitters are in operation, through certain parts of the light emitting surface light is emitted that is a combination of light in the first wavelength range and light in the second wavelength range, and through certain other parts of the light emitting surface light is emitted that comprises mainly light of the first wavelength. Thus, a pattern may be visible which is defined by the pattern of areas with the phosphor material and the areas without the phosphor material. A disadvantage is that the light emission is not optimal because of the use of different areas with or without phosphor material.

SUMMARY OF THE INVENTION

It is an object of the invention to provide a phosphor-enhanced light source which has a better light emission.

A first aspect of the invention provides a phosphor-enhanced light source as claimed in claim 1. A second aspect of the invention provides a luminaire as claimed in claim 13. Advantageous embodiments are defined in the dependent claims.

A phosphor-enhanced light source for presenting a visible pattern in accordance with the first aspect of the invention comprises a light exit window, a light emitter, a luminescent layer. The light exit window emits light into the ambient of the phosphor-enhanced light source. The light emitter emits light of a first color distribution towards the light exit window. The luminescent layer comprises luminescent material to absorb a part of the light of the first color distribution and to convert a part of the absorbed light into light of a second color distribution. At least a part of the luminescent layer forms at least a part of the light exit window. The luminescent layer comprises a first area and a second area that is different from the first area. The first area and the second area form a pattern. A first light conversion characteristic of the first area is similar to a second light conversion characteristic of the second area to obtain a first light emission by the first area into the ambient and a second light emission by the second area into the ambient. The first light emission and the second light emission are experienced as similar light emissions by the human naked eye if the light emitter is in operation. A first reflection characteristic of the first area is different from a second reflection characteristic of the second area to obtain a first ambient light reflection by the first area that is different from a second ambient light reflection by the second area if light impinges from the ambient on the respective first area and second area.

The difference between the first ambient light reflection and the second ambient light reflection is visible by the human naked eye.

The invention provides a luminescent layer which comprises at least two disjoint areas which form the pattern and which have the same light conversion characteristics. The light emitted by the light emitter is in the first area converted to a first light emission and in the second area converted to a second light emission as a consequence of the first light conversion characteristic of the first area and the second light conversion characteristic of the second area, respectively. "A light emission" means in this context an emission of light having a specific color distribution and may have a specific light intensity. The first conversion characteristic and the second conversion characteristic are such that the naked human eye experiences the first light emission being similar to the second light emission. Although similar does not directly mean "equal", it means that the human naked eye may only experience a slight difference between the first light emission and the second light emission. This implies that the intensity and the color of the first light emission and of the second light emission may slightly deviate. It implies also that the spectrum of the first light emission and the spectrum of the second light emission may deviate, as long as those spectra are experienced by the human naked eye as spectra of about the same color. Thus, when the light emitter is in operation and emits light, the viewer experiences the light emissions of the respective first area and second area as substantially equal light emissions. This is experienced by viewers, who look towards the light exit window of the phosphor-enhanced light source, as a convenient light emission. As such the light emission of the phosphor-enhanced light source is improved when the light emitter of the phosphor-enhanced light source is in operation. The respective conversion characteristic of the first area or the second area depends on, among other parameters, how much light emitted by the light emitter is transmitted through the respective area without being converted, how much light of the first color distribution is converted towards light of the second color distribution by the luminescent material of the respective area, and how much light is absorbed in the respective areas. Thus, the first light emission and the second light emission both contain light of the second color distribution and may both contain light of the first color distribution.

Further, the first area has a first reflection characteristic which is different from a second reflection characteristic of the second area and thereby a first ambient light reflection and a second ambient light reflection is obtained. The respective reflection characteristics are related to the reflection of light from the ambient by the first area and by the second area. Thus, the ambient light reflections of the respective areas are different such that the human naked eye experiences the respective ambient light reflections as different reflections. The first area and the second area form a specific pattern which the viewer is able to see. The pattern may be an image that is presented to the person.

It is to be noted that the experienced light emission of the phosphor-enhanced light source as a whole, which is the light emission that the human naked eye sees when it looks towards the phosphor-enhanced light source, strongly depends on the intensity of the ambient light and the intensity of the light that is emitted by the light emitter. If the light emitter is not in operation, the person who looks towards the phosphor-enhanced light source only sees the respective ambient light reflections and, consequently, the person sees the pattern. If the light emitter is emitting light, and there is no ambient light, the person only sees the respective light emissions, and, consequently, no pattern is seen. If the light emitter is emitting light, and if the intensity level of the ambient light is very low, the human naked eye will mainly see the respective light emissions. Thus, depending on a ratio between the intensity of the light emitted by the light emitter and the intensity of the ambient light the pattern may be seen or an uniform light emission is experienced.

Thus, the current invention provides a whole range of new applications wherein a presentation of the pattern or the image is desired when the phosphor-enhanced light source is not in operation or emits light at a relatively low light intensity compared to the intensity of the ambient light, while the same phosphor-enhanced light source has to have a high quality light emission if the phosphor-enhance light source emits light at a relatively high intensity. For example, a luminaire for use in a shop, an office or a home with a relatively large light emission surface may incorporate the phosphor-enhanced light source to have a patterned light emission surface during daylight, while during darkness a substantially homogeneous light output is obtained for lighting the office of the home. The pattern is, for example, an emergency sign which points people towards an emergency exit. Such a phosphor-enhanced light source provides, if the light emitter is not anymore functioning because of a power breakdown, still important information to users in cases of emergency (assuming that there is still some ambient light, such as daylight). In another embodiment, the visible pattern may also be decorative to prevent that a relatively large luminaire is a large non-patterned surface.

Optionally, the first light emission and the second light emission are at least experienced as similar light emission with respect to: a color point in a color space, or a correlated color temperature (CCT). If the color point and/or the correlated color temperature of the first light emission and of the second light emission are about the same, a high quality light emission by the phosphor-enhanced light source is obtained.

Optionally, the first light emission and the second light emission being experienced as equal light emissions by the human naked eye if the light emitter is in operation.

Optionally, the first light emission and the second light emission are at least experienced as equal light emission with respect to: a color point in a color space, or a correlated color temperature.

Optionally, the first light emission has a first color point and the second light emission has a second color point. The difference between the first color point and the second color point is smaller than 10 SDCM. SDCM is the abbreviation of Standard Deviation of Color Matching and is in the field of lighting a well-known measurable characteristic which expresses to which extent two color points within a color space are experienced as an equal color. If the difference is smaller than 10 SDCM a viewer may see a minimal difference and the colors are experienced as almost equal colors. In an embodiment the difference is smaller than 5 SDCM and in yet a further embodiment, the difference is smaller than 2 SDCM. If the difference is even smaller than 10 SDCM the human naked eye experiences the colors of the respective light emissions as the same color and even a higher quality light emission is obtained by the phosphor-enhanced light source.

Optionally, the first light emission has a first color rendering index ($CRI_1$) and the second light emission has a second color rendering index ($CRI_2$). A difference between a first color rendering index and the second color rending index is not larger than 10. Although a difference in color rendering indices is often not visible to the human naked eye if the respective color points are about the same and/or the respective color temperatures are about the same, the color rending index is important with respect to the color rendering of objects which are lighted by the phosphor-enhanced light source. As such it is advantageous to have the first light emission which has about the same color rendering index as the second light emission in order to obtain a high quality light emission by the phosphor-enhanced light source. In another embodiment the difference between the first color rendering index and the second color rending index is smaller than 5. In yet a further embodiment, the difference between the first color rendering index and the second color rending index is smaller than 2.

Optionally, the first reflection characteristic differs from the second reflection characteristic with respect to at least one of i) the first area absorbs a first portion of light of the light impinging from the ambient and the second area absorbs a second portion of the light impinging from the ambient, wherein the first portion differs from the second portion, ii) the first area has a first scattering characteristic, and the second area has a second scattering characteristic, the first scattering characteristic being different from the second scattering characteristic. If the first area has a different absorption characteristic compared to the absorption characteristic of the second area, the person who looks towards the luminescent layer receives from the first area another light distribution than the light distribution that is received from the second area. The light distribution that is received by the person is based on the light distribution of the ambient light minus the light distribution of the absorbed part. If the scattering characteristics differ, the person who looks towards the first area and the second area receives another amount of light from the respective areas because, depending on the respective scattering characteristics, less or more light is scattered into the direction of the person. It is to be noted that absorbing a portion of light impinging from the ambient comprises at least one of, or a combination of, absorbing a specific spectrum, and absorbing a specific amount of light.

Optionally, the absorbed first portion differs from the absorbed second portion with respect to an amount of light that is absorbed and/or the absorbed first portion differs from the absorbed second portion with respect to a color of the light that is absorbed. If the respective reflection characteristics differ with respect to the absorption of an amount of light, the first area and the second area reflect a different intensity of light which is visible to a viewer who look to wards the light exit window of the phosphor-enhanced light source and different levels of "grey" can be seen if the impinging ambient light is white light. If the respective reflection characteristics differ with respect to the absorption of color, the first area and the second area have a different color-appearance which is visible to a viewer who looks towards the light exit window of the phosphor-enhanced light source. The color-appearance is the result of the fact that a part of the color spectrum of the impinging light is absorbed, for example by the luminescent material, and the reflected spectrum of light has a color that is complementary to the absorbed color spectrum. The color spectrum of the impinging ambient light influences the color-appearance as well, however, if the first area reflects another part of the color spectrum of the impinging ambient light than the second area, the user experiences different colors at the respective areas. Thus, the pattern formed by the first area and the second area is visible through different colors.

Optionally, the first area comprises, in a direction perpendicular to the luminescent layer, a first stack of layers comprising at least a first luminescent sublayer comprising the luminescent material. The second area comprises, in a direction perpendicular to the luminescent layer, a second stack of layers comprising at least a second luminescent sublayer comprising the luminescent material. The first stack of layers has arranged the first luminescent sublayer at a side of the first stack of layers that is facing the ambient, the second stack of layers has arranged the second luminescent sublayer not at a side of the second stack of layers that is facing the ambient. If the respective luminescent sublayers with the luminescent material are arranged at a different position in the respective stacks of layers, the top layer which is facing the ambient is different and as such the reflection characteristic is different. The first area has the first luminescent layer arranged at a position facing the ambient and as such the first area has the specific color-appearance because the luminescent material absorbs a part of the color spectrum of the impinging ambient light. The second area does not have this specific color-appearance. Both stacks comprise the respective luminescent sublayers and as such the conversion characteristics of both layers are substantially equal.

Optionally, the first stack of layers further comprises a first diffusing sublayer. The second stack of layers further comprises a second diffusing sublayer. The second stack of layers has arranged the second diffusing sublayer at a side of the second stack of layers that is facing the ambient. Thus, both stacks are substantially equal and have a comparable conversion characteristic, and the respective layers of each stack facing the ambient are different and as such the reflection characteristics of the respective first area and second area are different.

Optionally, the luminescent layer comprises a further luminescent material for absorbing a part of the light of the first color distribution and for converting a part of the absorbed light into light of a third color distribution. The first stack of layers further comprises a first further luminescent sublayer comprising the further luminescent material and not comprising the luminescent material. The second stack of layers further comprises a second further luminescent sublayer comprising the further luminescent material and not comprising the luminescent material. The second stack of layers has arranged the second further luminescent sublayer at a side of the second stack of layers that is facing the ambient. Each one of the first area and the second area have a different layer in their respective stacks of layers arranged at the side which is facing the ambient, and as such the reflection characteristics of the respective areas are differently. The reflection characteristics are especially different with respect to the absorption of a specific color spectrum. The luminescent material and the further luminescent material each absorb a different part of the first color spectrum and as such they contribute to a different color-appearance of the first area and the second area. Further, the luminescent material may differ from the further luminescent material with respect to scattering characteristics. For example, an inorganic phosphor scatters impinging light to a large extent, while organic phosphors are often transparent and are often used in a transparent matrix polymer and as such the organic phosphors do not contribute to the scattering of light. It is to be noted that the respective stacks of layers of the first area and the second area both comprise a layer with the luminescent material and a layer with the further luminescent material and as such their conversion characteristics are substantially equal.

Optionally, the luminescent layer comprises another luminescent material for absorbing a part of the light of the first color distribution and for converting a part of the absorbed light into light of a fourth color distribution. The first area comprises a first mix of the luminescent material and the another luminescent material. The second area comprises a second mix of the luminescent material and the another luminescent material. The second mix is different from the first mix. If the first mix is different from the second mix, the color-appearance of the first area is different from the second area. Further, the mixes have to be tuned such that the conversion characteristics of the respective first area and the second area are substantially equal. In an embodiment, equal conversion characteristics for the different mixes of luminescent material may be obtained by use of, for example, a third luminescent material or another color filtering material in one of the mixes.

Optionally, the amount of the another luminescent material in the first mix is zero, and the amount of the luminescent material in the second mix is zero. Thus, each one of the first area and the second area comprises a different luminescent material. The concentration of the different luminescent material may be tuned such that equal conversion characteristics are obtained for the first area as well as for the second area, while at the same time both areas reflect impinging ambient light differently, for example, both areas have a different color-appearance.

Optionally, the luminescent material is an inorganic luminescent material. The further luminescent material or the another luminescent material is an organic luminescent material. With luminescent materials of a different nature the same conversion characteristics may be obtained, while their reflection characteristics differ. As discussed previously, an inorganic luminescent material has often a strong color-appearance and scatters a relatively large amount of light, and an organic luminescent material is often transparent resulting in a minor color-appearance, a small amount of scattering, and often a limited amount of reflection of light.

According to a second aspect of the invention, a luminaire is provided which comprises a phosphor-enhanced light source according to the first aspect of the invention.

The luminaire according to the second aspect of the invention provides the same benefits as the phosphor-enhanced light source according to the first aspect of the invention and has similar embodiments with similar effects as the corresponding embodiments of the system.

In this context, the light emitted by the light emitter, light of the respective light emission, or light of the respective ambient light reflections typically comprises light having a specific spectrum. The specific spectrum may, for example, comprise a primary color having a specific bandwidth around a predefined wavelength, or may, for example, comprise a plurality of primary colors. The predefined wavelength is a mean wavelength of a radiant power spectral distribution. The light of a primary color, for example, includes Red, Green, Blue, Yellow and Amber light. The specific spectrum may also comprise mixtures of primary colors, such as Blue and Amber, or Blue, Yellow and Red. By choosing, for example, a specific combination of the Red, Green and Blue light substantially every color can be reflected or emitted by the phosphor-enhanced light source, including white. It is further to be noted that the specific spectrum may be any spectrum in the visible light spectral range and may include wavelengths outside the visible light spectrum range, such as wavelengths in the UV or infrared spectral range.

It is to be noted that the luminescent material, the further luminescent material, and the another luminescent material each have a specific absorption spectrum. This spectrum may fully or partially overlap with the first color distribution, and the overlapping part determines which part of the light of the first color distribution may be absorbed by the respective luminescent materials. Further, the absorption spectrum of the respective luminescent materials may also have an overlap with the second, third or fourth color distribution and, depending on the specific configuration of the luminescent material, the respective luminescent materials may also absorb light that is generated by another luminescent material.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the phosphor-enhanced light source and luminaire, which correspond to the described modifications and variations of the phosphor-enhanced light source, can be carried out by a person skilled in the art on the basis of the present description.

Figure 1A:
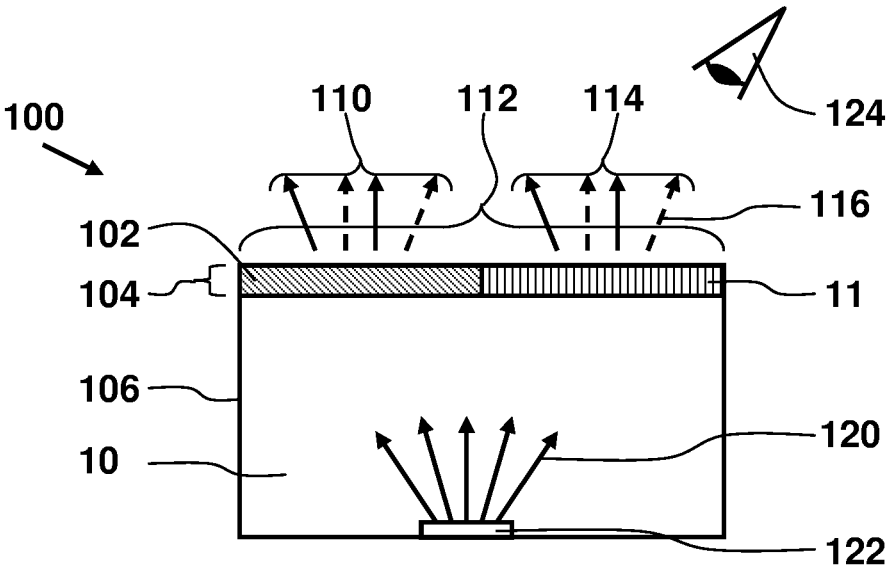
FIG. 1*a* schematically shows a cross-section of a phosphor-enhanced light source according to the first embodiment of the invention of which the light emitter emits light, FIG. 1*b* schematically shows the same embodiment of the phosphor-enhanced light source wherein the light emitter is not in operation, FIG. 2*a* schematically shows a cross-section of an embodiment of a luminescent layer comprising diffusing sublayers and luminescent sublayers, FIG. 2*b* schematically shows a cross-section of another embodiment of a luminescent layer comprising diffusing sublayers and luminescent sublayers, FIG. 3*a* schematically shows a cross-section of a further embodiment of a luminescent layer comprising a first area comprising a first luminescent material and a second area comprising a second luminescent material, FIG. 3*b* schematically shows a cross-section of an embodiment of a luminescent layer comprising sublayers comprising different luminescent materials, FIG. 3*c* schematically shows a cross-section of an embodiment of a luminescent layer comprising a combination of areas of FIG. 2*a*, FIG. 3*a* and FIG. 3*b*, FIG. 4*a* schematically shows a cross-section of an embodiment of a phosphor-enhanced light source with a light emitter in a side-emitting arrangement, FIG. 4*b* schematically shows another embodiment of a phosphor-enhanced light source arranged in a retro-fit bulb configuration, FIG. 5 schematically shows an embodiment of a luminaire according to the second aspect of the invention, and FIG. 6 schematically shows another embodiment of a luminaire according to the second aspect of the invention.

It should be noted that items denoted by the same reference numerals in different Figures have the same structural features and the same functions, or are the same signals. Where the function and/or structure of such an item have been explained, there is no necessity for repeated explanation thereof in the detailed description.

The figures are purely diagrammatic and not drawn to scale. Particularly for clarity, some dimensions are exaggerated strongly.

DETAILED DESCRIPTION OF THE EMBODIMENTS

Figure 1B:
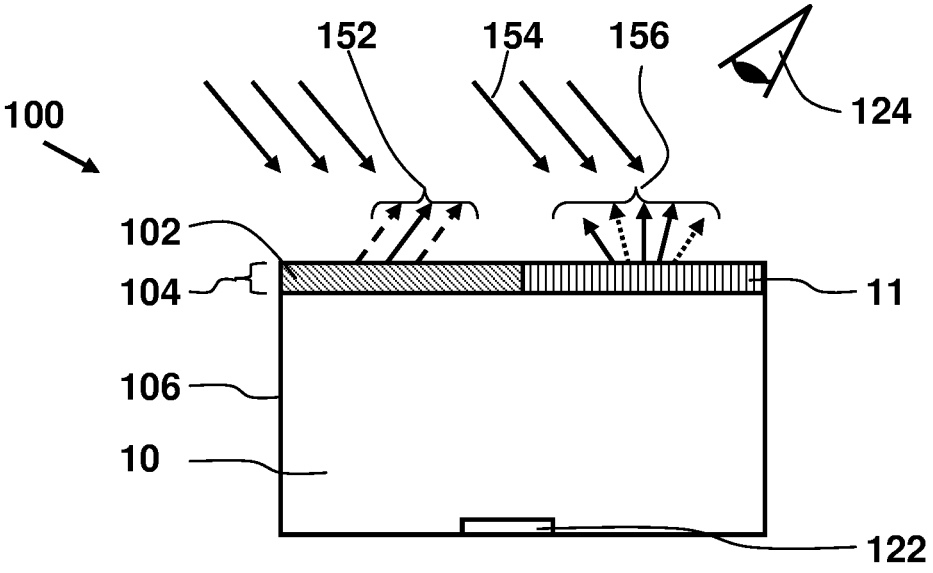

A first embodiment is shown in FIGS. 1*a* and 1*b*. FIG. 1*a* presents a phosphor-enhanced light source 100 which comprises a housing 106 which encloses a light mixing cavity 108. Within the light mixing cavity 108 is provided a light emitter 122. The housing 106 further comprises a light exit window 112 and comprises a luminescent layer 104 which forms the light exit window 112. The luminescent layer 104 comprises luminescent material for converting light of a first color distribution into light of a second color distribution. The luminescent layer 104 is subdivided in a first area 102 and a second area 118. The first area 102 and the second area 118 have both a substantially equal conversion characteristic. If light 120 impinging on the luminescent layer 104 at a side facing the light mixing cavity 108 is partly transmitted through and partly converted by the first area 102 and the second are 118, the light emissions 110, 114, respectively, of the first area 102 and of the second area 114 have an equal light characteristic. It is schematically shown in FIG. 1*a* that the combination of light of the first color distribution and light 118 of the second color distribution is equal in the light emission 110 of the first area 102 and in the light emission 114 of the second area 118. Thus, a viewer 124 who looks towards the luminescent layer 104 sees a substantially homogeneous light emission along a whole light exit window of the phosphor-enhanced light source 100. The viewer 124 sees at the first area 102 and at the second area 118 substantially the same color and sees at the first area 102 and at the second area 118 the substantially the same light intensity.

FIG. 1*b* presents the phosphor-enhanced light source 100 in a state wherein the light emitter 122 is not emitting light. Light 154 from the ambient impinges on the first area 102 and the second area 118. The first area 102 and the second area 118 each have a different reflection characteristic such that the light 154 which impinges from the ambient is reflected differently by the first area 102 and the second are 118. The reflected light 152 of the first area 102 is mainly the result of reflection according to the law of "angle of incidence is the angle of reflection", however, it is schematically drawn that the color distribution is changed at the reflection. The reflected light 156 of the second area 118 has another light emission distribution than one would expect on basis of the law of "angle of incidence is the angle of reflection" and thus the second area partly scatters the light, and it is schematically presented that the color distribution is also changed at the reflection and the color distribution differs from the color distribution of the light 152 that is reflected by the first area 102. Thus, the human naked eye 124 who looks towards the luminescent layer 104 of the phosphor-enhanced light source 100 at moments in time when the light emitter 122 is not operating, experiences a different color of light and/or different intensity of light at the first area 102 and at the second area 118. If the light emitter 122 is operating but emits a relatively small amount of light compared to the amount of light 154 from the ambient that impinges on the luminescent layer 104, the human naked eye 124 still experiences a different color and/or different intensity of light at the respective areas 102, 118.

Figure 2A:
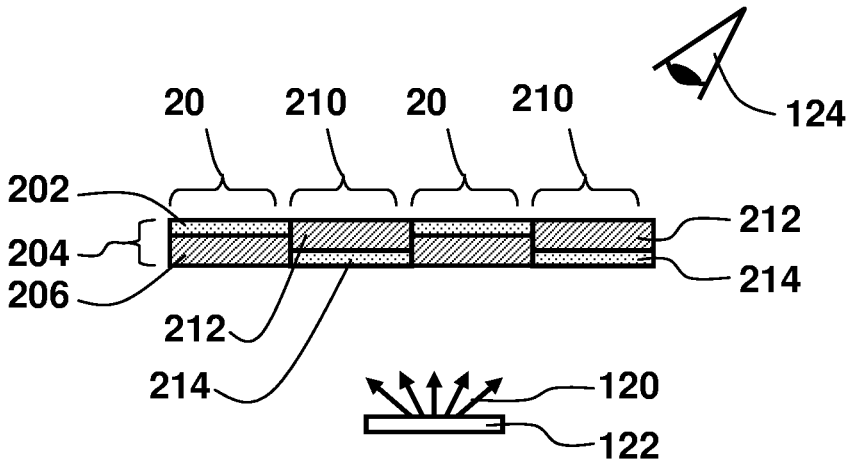

FIG. 2*a* presents a cross-section of an embodiment of a luminescent layer 204. For clarity a position of the light emitter 122 is indicated as well as a position of the viewer 124 who looks towards the luminescent layer 204. In order words, in the drawing of FIG. 2*a* the upper surface of the luminescent layer 204 is facing to the ambient of a phosphor-enhanced light source which comprises the luminescent layer 204, and the lower surface is facing a light mixing cavity of the phosphor-enhanced light source. The luminescent layer 204 comprises a first area 208 and a second area 210. The first area 208 and the second area 210 are drawn twice in the cross-section, but the first area 208 and/or the second area 210 may be one area, or may be an area that is subdivided into two subareas that have, except their size and position, the same characteristics. The first area 208 and the second area 210 form a pattern which is visible to a person who is looking to the phosphor-enhanced light source which comprises the luminescent layer 204 if the light emitter of the phosphor-enhanced light source is not emitting light. The luminescent layer 204 comprises a luminescent material for absorbing a portion of the light of the first color distribution as emitted by the light emitter 122 and converting the absorbed light to light of a second color distribution.

The first area 208 comprises a first stack of layers which comprises a first sublayer 202 and a second sublayer 206. The first sublayer 202 is diffuser which is light transmitting, but diffuses the light which is transmitted through the first sublayer 202 and which diffuses light which impinges on the first sublayer 202. Thus, light which impinges from the ambient on the first area 208 is reflected in a plurality of directions. The second sublayer is a luminescent layer which comprises luminescent material that converts the portion of light of the first color distribution to light of a second color distribution. Consequently, if the light emitter 122 is in operation, a portion of the light emitted by the light emitter is converted into light of the second color distribution, and thus, the total light emission by the top surface of the first area is a combination of light that directly originates from the light emitter and light of the second color distribution.

The second area 210 comprises a second stack of layers. The second stack of layers comprises a third sublayer 214 which is a diffuser, and comprises a fourth sublayer 212 which comprises the luminescent material. The third sublayer 214 has about the same characteristics as the first sublayer 202 and the fourth sublayer 212 has about the same characteristics as the second sublayer 206 however, the order of the third sublayer 214 and the fourth sublayer 212 is different compared to the order of the sublayers 202, 206 in the first area 208. If the light emitter 122 is emitting light, an amount of light is converted into light of the second color distribution and the converted amount of light is comparable to the amount of light that is converted in the first area. As such, the light emissions of the first area 208 and of the second area 210 have about the same color. If the light emitter 122 is not emitting light, the second sublayer 206 has a color-appearance, which means that the viewer experiences the reflected ambient light as light of a specific color. A specific part of the color spectrum of the light from the ambient which impinges on the fourth sublayer 212, which comprises the luminescent material, is absorbed by the luminescent material, and the remaining (not absorbed part of) the ambient light is reflected. For example, if the luminescent material mainly absorbed blue light, the remaining reflected light does not comprise much energy in the blue spectral range and as such the reflected ambient light is seen by the viewer as orange (or yellow-orange, or orange-red, depending on the original color spectrum of the ambient light). Thus, the first area 208 reflects the ambient light without changing its color, but by randomly changing angular light emission directions of the light through scattering, and the second area 210 absorbs some colors of the reflected ambient light and, consequently, reflects another color distribution. Depending on specific characteristics of the luminescent material, the second sublayer 210 may also scatter/diffuse the reflected light, which is for example often the case when inorganic phosphor particles are used. Further, the fourth sublayer 212 and the second sublayer 206 may be relatively transparent if organic phosphor molecules are molecularly dissolved in a matrix polymer, and the reflection by the sublayer 206, 212 may be more to the law of "angle of incidence is the angle of reflection". Especially inorganic phosphors have a strong color-appearance and are advantageous to create a visible pattern/image at the upper surface of the luminescent layer 204 (if the light emitter 122 is not emitting light).

Figure 2B:
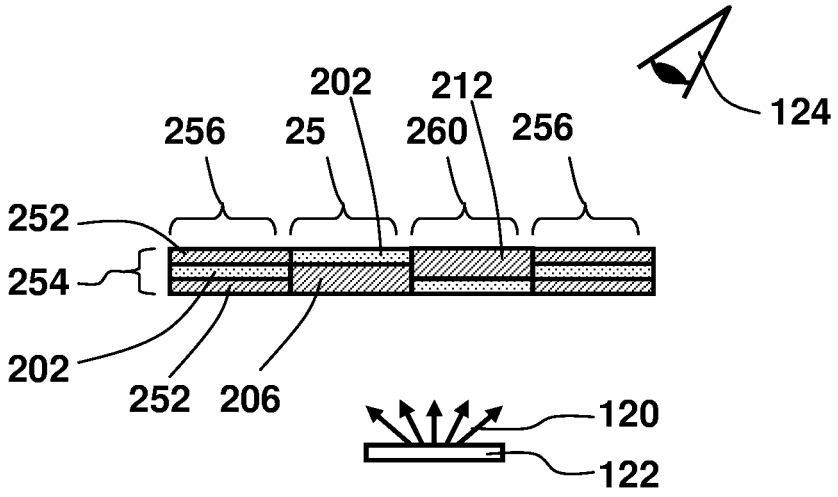

In FIG. 2*b* is presented an alternative embodiment of a luminescent layer 254. As discussed in the previous embodiments, the luminescent layer 254 comprises a luminescent material for converting light of a first color distribution to light of a second color distribution. The luminescent layer 204 comprises a first area 256, a second area 258 and a third area 260. The second area 258 and the third area 260 are arranged in the same configuration as, respectively, the first area 208 and the second area 210 of FIG. 2*a*. The first area 256 comprises a stack of three sublayers. The sublayer 252 comprises the luminescent material in the same concentration as the second sublayer 206 of the second area 258 and has half the thickness of the second sublayer 206 of the second area 258. The stack of three sublayers comprises the sublayer 252 with luminescent material twice, to obtain the same conversion characteristic as the second area 258 and the third area 260. The stack of three sublayers of the first area 208 comprises the diffuser 202 which is also provided in the stack of layers of, respectively, the second area 258 and of the third area 260. The diffuser 202 is interposed between two sublayers 252 in the first area 256.

If the light emitter 122 is not emitting light, as discussed previously in the context of FIG. 2*a*, the ambient light is reflected differently by the second area 258 and the third area 260. The first area 256 of FIG. 2*b* has as a top layer also a sublayer 252 which comprises the luminescent material, but the thickness of the sublayer 252 is different from the thickness of the top layer 212 of the third area 260 and as such a reflection characteristic of the first area 256 differs also from the reflection characteristics of the second area 258 and the third area 260. Consequently, the viewer 124 sees, if the light emitter 122 is not emitting light, different areas 256, 258, 260 which each one reflects the impinging ambient light differently, and as such a pattern/image may be seen by the viewer 124 which comprises three different colors/grey tones.

Figure 3A:
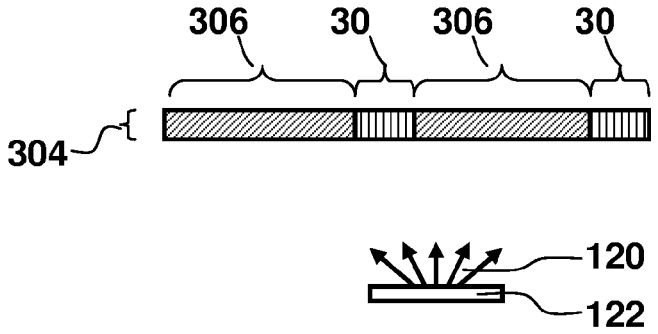

In FIG. 3*a* is schematically shown a cross-section of a further embodiment of a luminescent layer 304 comprising a first area 306 comprising a first luminescent material and a second area 308 comprising a second luminescent material. The first luminescent material is different from the second luminescent material, however, a concentration of the first luminescent material and a concentration of the second luminescent material are chosen such that both the first area 306 and the second area 308 have substantially the same conversion characteristics. Thus, per area unit, about the same amount of light emitted by the light emitter is transmitted through the first area 306 and the second area 308, and about the same amount of light emitted by the light emitter is converted to light of the second color distribution. However, the first luminescent material and the second luminescent material both have a different color-appearance, which means that another portion and/or another amount of the color spectrum of the impinging ambient light is absorbed and as such different color distributions are reflected by the first area 306 and by the second area 308.

For example, the first area 306 comprises an inorganic luminescent material and the second area 308 comprises an organic luminescent material. As discussed previously, inorganic luminescent materials have a strong color-appearance, while organic luminescent materials do not have such a strong color-appearance. Organic luminescent molecules are transparent and are often molecularly dissolved in a transparent matrix polymer. As such, the second area 308 comprising the organic luminescent material does not reflect much light and does not have a strong color-appearance.

It is to be noted that the first area 306 may comprise a mix of luminescent materials, and that the second area 308 may comprise another mix of luminescent materials such that the conversion characteristics of both areas 306, 308 are substantially the same with respect to a color parameter, while the reflection characteristics of both area 306, 308 are different.

Figure 3B:
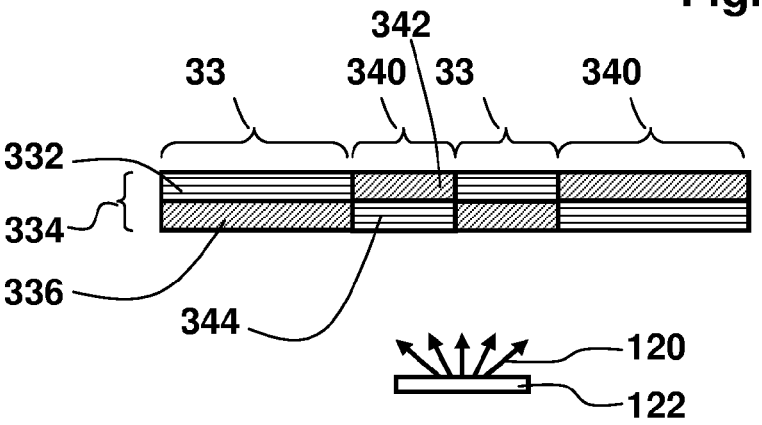

In FIG. 3*b* is schematically shown a cross-section of another embodiment of a luminescent layer 334 which comprises sublayers 332, 336, 342, 344 comprising different luminescent materials. The luminescent layer 334 comprises a first area 338 and a second area 340. As well as the first area 338 and the second are 340 comprise a stack of two sublayers 332, 336, 342, 344. Sublayers 332, 344 have about the same characteristics and sublayers 336, 342 have about the same characteristics. However, an order of the sublayers 332, 336 is in the first area 338 different from a order of the sublayers 342, 344 in the second area 340. Thus, the sublayer which faces the ambient in the first area 338 is sublayer 332, while in the second area 340 sublayer 342 faces the ambient (which has different characteristics). The sublayers 332, 344 comprises a first luminescent material, while the sublayer 336, 342 comprises a second luminescent material, and as such to sublayers of the respective first area 338 and the second area 340 that face the ambient have different color-appearance because of the presence of different luminescent materials in the different sublayers 332, 342. As such, if the light emitter 122 is not emitting light, ambient light is differently reflected, especially in relation to colors that are not reflected by the different sublayers 332, 342. Because the first area 338 and the second area 340 have both the two sublayers with equal characteristics, the conversion characteristics of both the first area 338 and the second area 340 are substantially equal.

Figure 3C:
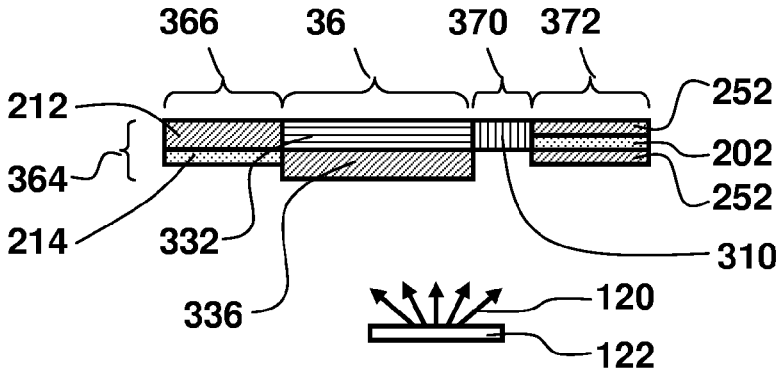

In FIG. 3*c* are the previously discussed embodiments combined to a further embodiment of the luminescent layer 364. A first area 366 comprises a stack of a first sublayer 212 comprising a first luminescent material, and of a second sublayer which is a diffuser 214. A second subarea 368 comprises a stack of layers of a third sublayer 332 which comprises a second luminescent material, and of a fourth sublayer 336 which comprises third luminescent material. A third subarea 370 consists of one layer which comprises a fourth luminescent material (or comprises a mix of luminescent materials). A fourth subarea 372 comprises a stack of three layers being a diffusing layer 202 interposed between two layers 252 comprising the first luminescent material of sublayer 206.

Different examples of stack of layers are discussed hereinafter. All discussed stacks of layers emit a color distribution having about the same color point in a color space and/or have about the same correlated color temperature if the stack of layers receives blue light from a blue emitting Light Emitting Diode (LED).

A first stack of layers comprises a 60 μm thick diffuser which comprises 10 wt % of $TiO_2$ which is dispersed in a matrix polymer PMMA (polymethylmethacrylate), a 135 μm layer of PMMA in which 0.1 wt % of an yellow-green organic phosphor F083 is dispersed, and a 52 μm thick layer of PMMA in which 0.1 wt % of a red-orange organic phosphor (comprising 70% F240 (orange) and 30% F305 (red)) is molecularly dissolved. The diffuser is facing the ambient, the 52 μm layer is facing the light mixing cavity of a phosphor-enhanced light source as discussed, for example, in the context of FIG. 1*a*. The first stack of layers emits light with a color point of (x,y)=(0.4493, 0.4123) in an CIE xyz color space, and the emitted light has a correlated color temperature of 2868 Kelvin. If light of the ambient impinges on the diffuser, the ambient light is reflected via scattering and the color of the scattered light is not changed by the diffuser. The discussed organic phosphors are available from BASF under the name Lumogen.

A second stack of layers comprises a 60 μm thick diffuser which comprises 10 wt % of $TiO_2$ which is dispersed in a matrix polymer PMMA, and a 189 μm thick PMMA layer in which 0.1 wt % of an orange phosphor (7.5% F305, 17.5% F240, 75% F083) is dispersed. The diffuser is facing the ambient and the 189 μm layer comprising phosphors is facing the light mixing cavity. The second stack of layers emits light with a color point of (x,y)=(0.4505, 0.4107) in the CIE xyz color space, and the emitted light has a correlated color temperature of 2836 Kelvin. If light of the ambient impinges on the diffuser, ambient light is reflected via scattering and the color of the scattered light is not changed by the diffuser.

A third stack of layers comprises a 75 μm thick PMMA layer in which 50 wt % of inorganic phosphor of Ce doped Yttrium Aluminum Garnet (Yag:Ce 2.1), a 27 μm thick PMMA layer comprising 0.1 wt % of an organic green-yellow-phosphor (F083), and a 27 μm thick PMMA layer comprising 0.05 wt % of a organic red phosphor (F305). The 75 μm thick layer is facing the ambient and the 27 μm tick layer comprising the red-phosphor is facing the light mixing cavity. The third stack of layers emits light with a color point of (x,y)=(0.4535, 0.4085) in the CIE xyz color space, and the emitted light has a correlated color temperature of 2773 Kelvin. If light of the ambient impinges on the 75 μm thick layer, the reflected ambient light does not comprise much light of a color which is absorbed by the Ce doped YAG.

A fourth stack of layers comprises one layer that is 156 μm thick and is a PMMA layer comprising 0.1 wt % of an organic phosphor mixture (12% F305, 18% F240, 70% F083, 4% $TiO_2$ scattering particles). The fourth stack of layers emits light with a color point of (x,y)=(0.4564, 0.4079) in the CIE xyz color space, and the emitted light has a correlated color temperature of 2727 Kelvin. If light of the ambient impinges on the 156 μm thick layer, the reflected ambient light does not comprise much light of a color which is absorbed by the orange phosphor.

The patterned luminescent layers of previous embodiments may be manufactured with various manufacturing technologies, such as there are, for example, printing, screen-printing, lithography, extrusion, injection moulding.

Figure 4A:
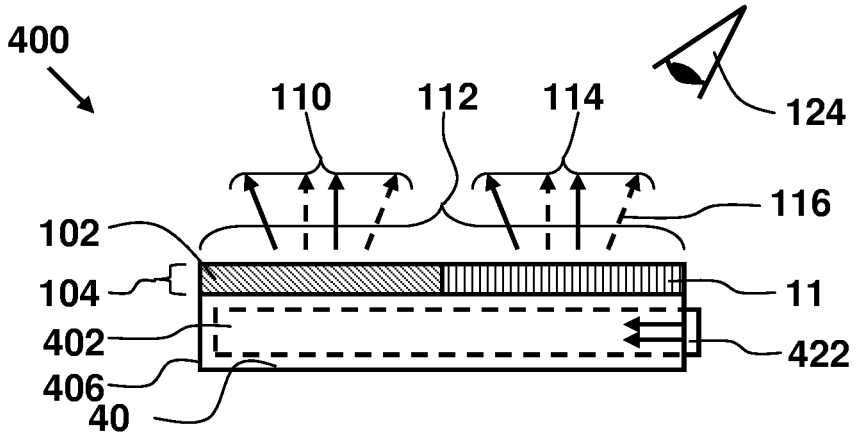

FIG. 4*a* shows another embodiment of a phosphor-enhanced light source 400. The phosphor-enhanced light source 400 is similar to the phosphor-enhanced light source 100 of FIG. 1, however, the light emitter 422 is arranged at another location. The light emitter 422 is arranged in a so-termed side-emitting arrangement. This means that the light emitter 422 emits light into a cavity 408 of a housing 406 through a light input window that is arranged perpendicular to a light exit window 112. The cavity 408 may comprise a light guiding structure 402 which comprises light outcoupling structures to obtain a substantially uniform light emission towards a luminescent layer 104.

Figure 4B:
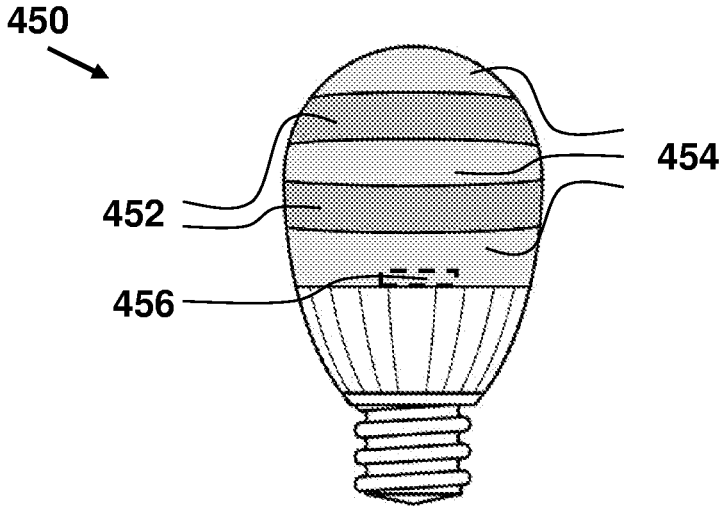

FIG. 4*b* shows an alternative embodiment of a phosphor-enhanced light source 450. A housing is formed by a retro-fit light bulb arrangement. Within the bulb is a cavity in which a light emitter 456 is arranged to emit light towards the bulb which forms a light exit window. The bulb is subdivided into different areas. Areas 452 of a first group of areas all have a first conversion characteristic and a first reflection characteristic. Areas 454 of a second group of areas 454 all have a second conversion characteristic and a second reflection characteristic. The first conversion characteristic and the second conversion characteristic are such that a light emission trough the areas 454 and the areas 452 are similar if the light emitter 456 is in operation. The first reflection characteristic and the second reflection characteristic are different such that ambient light which impinges on the bulb is reflected differently by the respective areas of the first group and of the second group. The embodiment shows that the luminescent layer of the phosphor-enhanced light source 450 is not necessarily a flat layer but may also be curved, for example, along a surface of a bulb.

Figure 5:
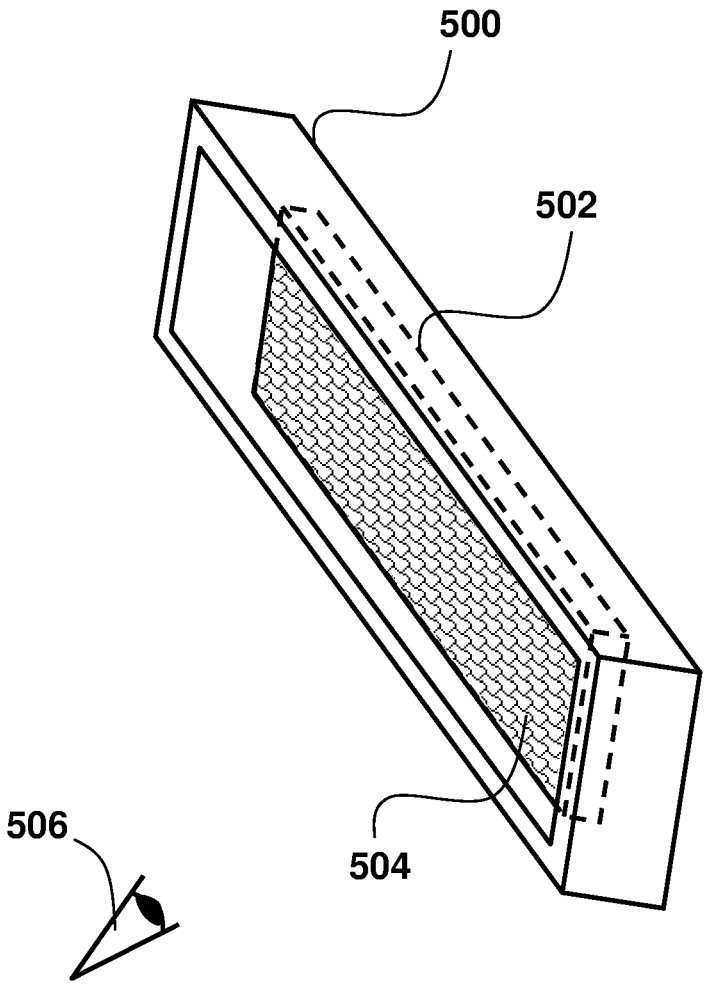

FIG. 5 shows a luminaire 500 according to a second aspect of the invention. The luminaire 500 comprise at least one phosphor-enhanced light source 502 according to the first aspect of the invention. A viewer who looks towards the luminaire 500 sees a pattern visible at the light exit window of the at least one phosphor-enhanced light source 502 if the light emitter of the at least one phosphor-enhanced light source 502 is not emitting light.

Figure 6:
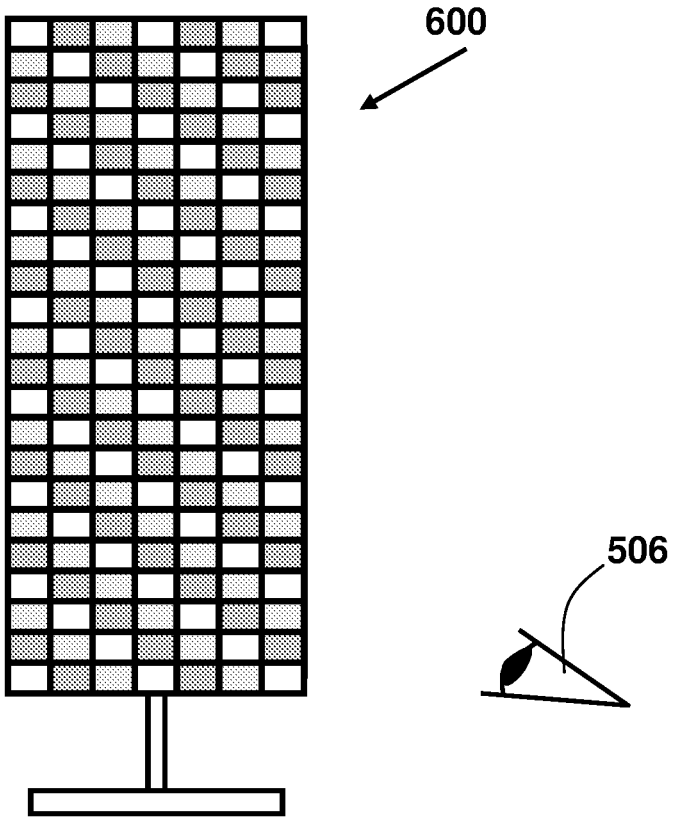

FIG. 6 shows another embodiment of a luminaire 600 according to the second aspect of the invention. The luminaire comprises a large surface which is the light exit window of the phosphor-enhanced light source that is comprises in the luminaire. The phosphor-enhanced light source has a plurality of areas in a pattern. The areas are subdivided in a first group, a second group and a third group. As shown by means of different tones in the figure, within one group all the areas have the same conversion characteristic and the same reflection characteristic.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A phosphor-enhanced light source for presenting a visible pattern, the phosphor-enhanced light source comprises:

a light exit window for emitting light into the ambient of the phosphor-enhanced light source, a light emitter for emitting light of a first color distribution towards the light exit window, a luminescent layer comprising luminescent material for absorbing a part of the light of the first color distribution and for converting a part of the absorbed light into light of a second color distribution, at least a part of the luminescent layer forming at least a part of the light exit window, the luminescent layer comprises a first area and a second area being different from the first area, the first area and the second area forming a pattern, wherein a first light conversion characteristic of the first area is similar to a second light conversion characteristic of the second area for obtaining a first light emission by the first area into the ambient and a second light emission by the second area into the ambient, the first light emission and the second light emission being experienced as similar light emissions by a viewer if the light emitter is in operation, and a first reflection characteristic of the first area is different from a second reflection characteristic of the second area for obtaining a first ambient light reflection by the first area that is different from a second ambient light reflection by the second area if light impinges from the ambient on the respective first area and second area, the difference between the first ambient light reflection and the second ambient light reflection being visible by the viewer.

2. A phosphor-enhanced light source according to claim 1, wherein the first light emission and the second light emission are at least experienced as similar light emissions with respect to: a color point in a color space, a correlated color temperature.

3. A phosphor-enhanced light source according to claim 2, wherein the first light emission has a first color point and the second light emission has a second color point, and the difference between the first color point and the second color point is smaller than 10 SDCM.

4. A phosphor-enhanced light source according to claim 2, wherein the first light emission has a first color rendering index and the second light emission has a second color rendering index, and a difference between a first color rendering index and the second color rending index is not larger than 10.

5. A phosphor-enhanced light source according to claim 1, wherein the first reflection characteristic differs from the second reflection characteristic with respect to at least one of:

the first area absorbs a first portion of the light impinging from the ambient and the second area absorbs a second portion of the light impinging from the ambient, wherein the first portion differs from the second portion, the first area has a first scattering characteristic, and the second area has a second scattering characteristic, the first scattering characteristic being different from the second scattering characteristic.

6. A phosphor-enhanced light source according to claim 5, wherein the absorbed first portion differs from the absorbed second portion with respect to an amount of light that is absorbed and/or the absorbed first portion differs from the absorbed second portion with respect to a color of the light that is absorbed.

7. A phosphor-enhanced light source according to claim 6, wherein in a direction perpendicular to the luminescent layer the first area comprises a first stack of layers comprising at least a first luminescent sublayer comprising the luminescent material, in a direction perpendicular to the luminescent layer the second area comprises a second stack of layers comprising at least a second luminescent sublayer comprising the luminescent material, and the first stack of layers has arranged the first luminescent sublayer at a side of the first stack of layers that is facing the ambient, the second stack of layers has arranged the second luminescent sublayer not at a side of the second stack of layers that is facing the ambient.

8. A phosphor-enhanced light source according to claim 7, wherein the first stack of layers further comprises a first diffusing sublayer, the second stack of layers further comprising a second diffusing sublayer, the second stack of layers has arranged the second diffusing sublayer at a side of the second stack of layers that is facing the ambient.

9. A phosphor-enhanced light source according to claim 7, wherein the luminescent layer comprises a further luminescent material for absorbing a part of the light of the first color distribution and for converting a part of the absorbed light into light of a third color distribution, the first stack of layers further comprises a first further luminescent sublayer comprising the further luminescent material and not comprising the luminescent material, the second stack of layers further comprises a second further luminescent sublayer comprising the further luminescent material and not comprising the luminescent material, the second stack of layers has arranged the second further luminescent sublayer at a side of the second stack of layers that is facing the ambient.

10. A phosphor-enhanced light source according to claim 6, wherein the luminescent layer comprises another luminescent material for absorbing a part of the light of the first color distribution and for converting a part of the absorbed light into light of a fourth color distribution, the first area comprises a first mix of at least the luminescent material and the another luminescent material, and the second area comprises a second mix of at least the luminescent material and the another luminescent material, the second mix being different from the first mix.

11. A phosphor-enhanced light source according to claim 10, wherein the amount of the another luminescent material in the first mix is zero, and the amount of the luminescent material in the second mix is zero.

12. A phosphor-enhanced light source according to claim 9, wherein the luminescent material is an inorganic luminescent material, the further luminescent material, or, the another luminescent material, is an organic luminescent material.

13. A luminaire comprising a phosphor-enhanced light source according to claim 1.

* * * * *